US005685264A

United States Patent [19]

Allen et al.

[11] Patent Number: 5,685,264

[45] Date of Patent: Nov. 11, 1997

[54] CAM MECHANISMS

[75] Inventors: Jeffrey Allen; Michael Miller, both of Norfolk, England

[73] Assignee: Lotus Cars Limited, Norfolk, Great Britain

[21] Appl. No.: 682,582

[22] PCT Filed: Jan. 24, 1995

[86] PCT No.: PCT/GB95/00130

§ 371 Date: Oct. 10, 1996

§ 102(e) Date: Oct. 10, 1996

[87] PCT Pub. No.: WO95/20098

PCT Pub. Date: Jul. 27, 1995

[30] Foreign Application Priority Data

Jan. 24, 1994 [GB] United Kingdom ..... 9401248

[51] Int. Cl.[6] ..... F01L 13/00; F01L 1/26; F01L 31/22

[52] U.S. Cl. ..... 123/90.16; 123/90.22; 123/90.39

[58] Field of Search ..... 123/90.15, 90.16, 123/90.17, 90.22, 90.27, 90.39, 90.4, 90.41, 90.44, 90.45, 90.46, 90.47

[56] References Cited

U.S. PATENT DOCUMENTS

| | | | |
|---|---|---|---|
| 4,799,463 | 1/1989 | Konno | 123/90.16 |
| 5,386,806 | 2/1995 | Allen et al. | 123/90.16 |

FOREIGN PATENT DOCUMENTS

| | | |
|---|---|---|
| 0 583 583 A2 | 2/1994 | European Pat. Off. . |
| 2 272 022 | 5/1994 | United Kingdom . |
| WO 91/12415 | 8/1991 | WIPO . |
| WO 92/10650 | 6/1992 | WIPO . |

*Primary Examiner*—Weilun Lo

*Attorney, Agent, or Firm*—Fulwider Patton Lee & Utecht, LLP

[57] ABSTRACT

The present invention provides a cam mechanism for controlling the motion of cylinder head valve means of an internal combustion engine, the cam mechanism comprising: a camshaft having first and second cams which rotate therewith, the first and second cams having different cam profiles, and a drive mechanism operable to relay drive from the first or the second cam to the controlled cylinder head valve means, the drive mechanism comprising first and second cam follower means engagable respectively with the first and second cams and engagement means for engaging the first and second cam follower means with their respective cams. The drive mechanism has three operating conditions: a first operating condition in which the first cam follower means is engaged with the first cam and the valve means is driven by the first cam; a second operating condition in which the second cam follower means is engaged with the second cam and the valve means is driven by the second cam; and a third operating condition in which both the first and second cam follower means are disengaged from the first and second cams.

15 Claims, 13 Drawing Sheets

12
11
10
26
40
39
24
16
31
27
30
23
15
29
19

12
11
10
26
40
25
24
16
30
15
29

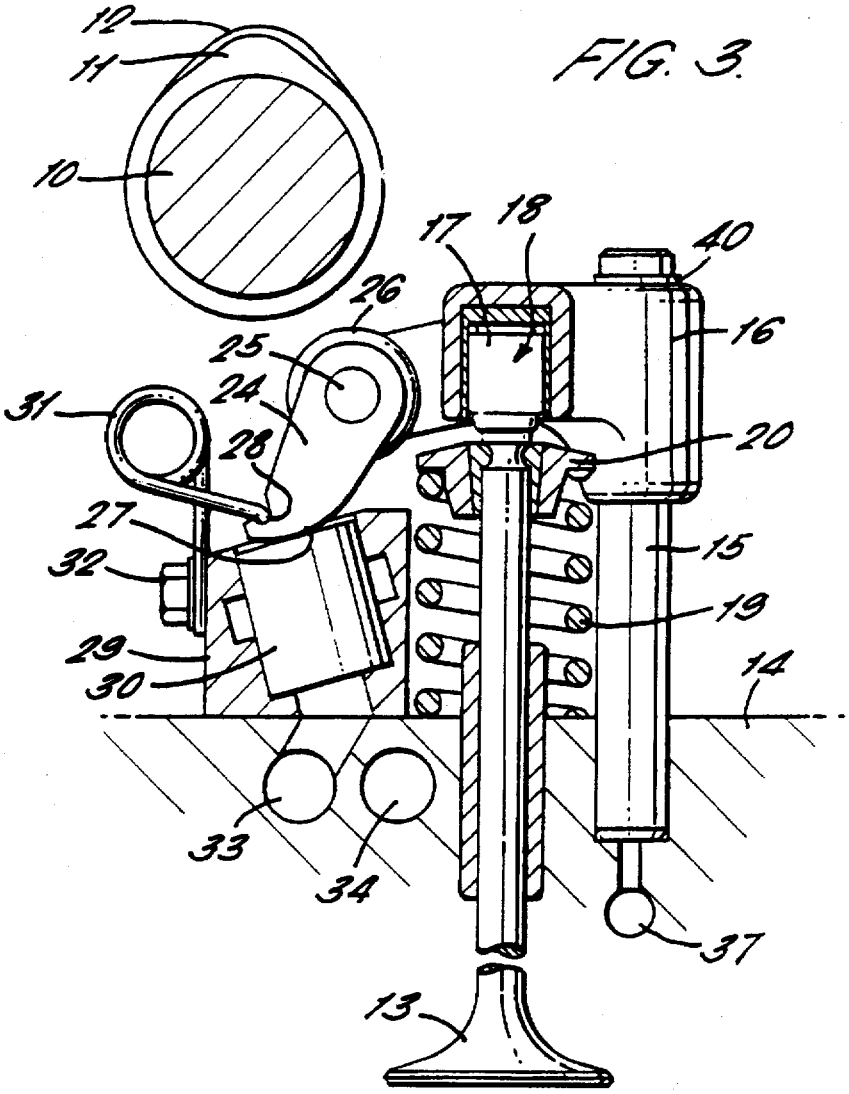
FIG. 3.
FIG. 4.
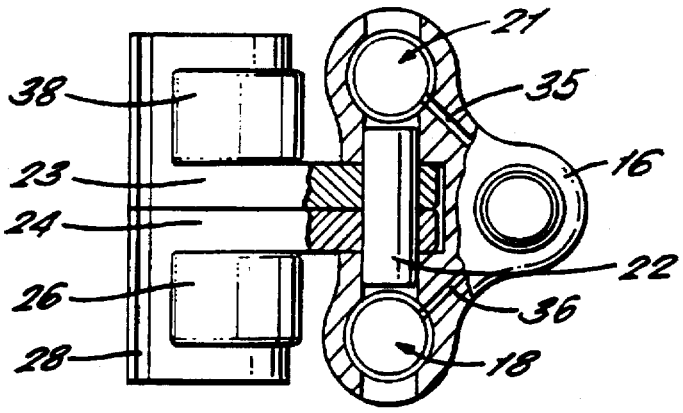

CAM MECHANISMS

The invention relates to a cam mechanism for the cylinder head valves of an internal combustion engine.

Cam mechanisms are well known. In conventional cam mechanisms a camshaft is provided with several cam lobes and the cylinder head valves of the engine are each driven by one of the cam lobes of the camshaft. In such conventional engines, the cylinder head valves are each driven by one cam profile only for all engine speeds and loads. This is disadvantageous since a cam profile best suited for high speed, high load operation of an internal combustion engine is not suited for low speed, low load operation and vice versa.

There have been a number of proposals for cam mechanisms which enable a valve to be driven by two different cam profiles, a first cam profile at low engine speeds and loads and second cam profile at higher engine speeds and loads. One example of such a system is described in WO-A-91/12415. In this published application a cam mechanism is shown which has a camshaft with first and second cam lobes mounted thereon for rotation therewith, the first and second cam lobes having different cam profiles. First and second finger followers are provided with first and second follower means respectively arranged to follow the profiles of the first and second cams. The first and second finger followers are rockable about fulcrum means comprising a fixed fulcrum in the form of a rocker shaft and a movable fulcrum. The first cam and the first follower means of the first finger follower together form a first short duration cam mechanism for low speeds of the engine, the movable fulcrum being in a first position at low speeds in which the second finger follower is out of engagement with the second cam. At higher speeds the movable fulcrum is moved to a position in which the second finger follower brings a second cam follower into abutment with the second high lift cam and the controlled valve is moved under the action of the cam of higher lift, the second cam.

In one embodiment shown in the prior art document WO-A-91/12415 two side by side valves are controlled by a cam mechanism which comprises two finger followers which sandwich a third finger follower. The two outer finger followers engage cam profiles for low speeds of the engine, the cam profiles being both low lift profiles, but the profiles being different to each other. At high speeds, the third inner finger follower engages a high lift cam which has a lift higher than both of the other two cams and thus both valves are controlled by the lift of the high lift cam.

The prior art specification WO-A-91/12415 teaches that the low lift cam can be replaced by a circular lobe, which imparts no lift to the control valve and therefore provides valve deactivation.

In the prior art system each valve can be controlled by only two different profiles, a profile for low speed operation and a profile for high speed operation. Whilst this is an improvement on the position in conventional engines where one profile is used for all engine speeds and loads, it is preferable to allow more than just two operating conditions of the cam mechanism, so that the valve motion can better meet the requirements of the engine throughout a range of engine conditions.

In EP-A-0213758 FIGS. 7 to 9 show a cam mechanism for controlling a pair of valves which has three operating conditions. In the first operating condition one valve is driven by a finger follower which engages a low lift cam, whilst the other valve remains deactivated since the finger follower that abuts it engages a circular raised portion. In the second operating condition both valves are driven by the low lift cam. In the third operating condition both valves are driven by a high lift cam. Thus one valve has three operating modes, low lift, high lift, deactivated, whilst the other has just two operating modes.

In EP-A-0276533 FIGS. 14 and 15 show a cam mechanism in which a camshaft has a low lift cam, a high lift cam and an annular raised portion. A pair of cylinder head valves are driven by the cam mechanism which has three operating conditions; a first in which both valves are deactivated, a second in which both valves are driven by a low lift cam and a third in which both valves are driven by a high lift cam.

In both EP-A-0213758 and EP-A-0276533 three finger followers are provided, one engaging the circular raised portion, one engaging the low lift cam and one engaging the high lift cam. An interconnecting mechanism allows two of the finger followers or all three of the finger followers to be connected together and changeover between operating modes is achieved in this way. The interconnecting mechanism comprises locking pins which extend between the finger followers and this requires good alignment and precise machining. In the deactivated state of a controlled valve or both controlled valves the finger followers are held in engagement with their respective cams or the raised portion by dedicated springs and thus friction losses are incurred in the valve deactivated state.

It would be difficult to fit hydraulic lash adjusters in either of the systems of EP-A-0231759 or EP-A-0276533 since it would be difficult to provide a supply of constant hydraulic pressure to hydraulic lash adjusters mounted in the finger followers because one bore is needed in the rocker arm for switching pressure.

In U.S. Pat. No. 5,099,806 a cam mechanism is shown which has three finger followers on a rocker shaft, a first in engagement with a circular portion of a camshaft, a second in engagement with a low lift cam and a third in engagement with a high lift cam. The second and third finger followers can be locked to move with the first finger follower by engagement means. When the second and third finger follower are free to move with respect to the first finger follower then a valve controlled by the cam mechanism is deactivated. When the second finger follower is locked to the first finger follower and the third finger follower is free to move with respect to the other two finger followers, then the controlled valve is activated and the valve is driven by the low lift cam. When the third finger follower is locked to the first finger follower then the valve is activated and is driven by the high lift cam. The engagement means comprises a pair of locking members, one for each of the second and third finger followers, which can be extended radially of the rocker shaft against biasing springs by the action of hydraulic pressure in a bore in the rocker shaft.

It would be difficult to incorporate hydraulic lash adjustment in the system of U.S. Pat. No. 5,099,806 since it would be difficult to supply constant hydraulic pressure to lash adjusters mounted in the finger followers because the bore in the rocker shaft is needed for the finger follower selection pressure. Also frictional losses are incurred during valve deactivation since the first, second and third finger followers will still be in contact with their respective cam lobes (although these are reduced by the use of a roller follower). The engagement means also requires quite precise machining and assembly for the alignment of locking member with recesses and this alignment must be maintained despite wear.

In U.S. Pat. No. 4,475,489 a cam mechanism is shown which has a camshaft which has a low lift cam and a high lift cam for each valve. A controlled cylinder head valve is engaged by two rocker arms which are each mounted on one of a pair of movable fulcrums. The movable fulcrums are alternately displaced to provide the controlled cylinder head valve with two operating conditions, a first operating condition in which the valve is controlled by a low lift cam and a second operating condition in which the valve is controlled by a high lift cam. The two movable fulcrums are moved between extended and retracted positions by two control cams on a control shaft, the two control cams engaging undersurfaces of the fulcrums. The control cams are mounted on a control shaft. For a multi-cylinder engine, if one control shaft is used then all the fulcrums would be moved together for all cylinders leading to valve to cam impacts and clatter. To avoid this problem many separate control shafts would be needed. No valve deactivation is provided by the system.

It would be difficult to provide hydraulic lash adjusters in the system of U.S. Pat. No. 4,475,489 since it would be difficult to provide a supply of hydraulic fluid where needed.

The present invention provides a cam mechanism for controlling the motion of cylinder head valve means of an internal combustion, the cam mechanism comprising:

a camshaft having first and second cams which rotate therewith, the first and second cams having different cam profiles, and a drive mechanism operable to relay drive from the first or the second cam to the controlled cylinder head valve means, the drive mechanism comprising first and second cam follower means engagable respectively with the first and second cams and engagement means for engaging the first and second cam follower means with their respective cams, wherein the first drive mechanism has three operating conditions, a first operating condition in which the first cam follower means is engaged with the first cam and the valve means is driven by the first cam, a second operating condition in which the second cam follower means is engaged with the second cam and the valve means is driven by the second cam, and a third operating condition in which both the first and second cam follower means are disengaged from the first and second cams.

The present invention thus provides three operating conditions using just two cams.

Preferably the cylinder head valve means is deactivated in the third operating condition.

In the valve deactivated condition there are low or no frictional losses incurred through cam follower engagement with a surface.

Preferably the first cam follower means comprises a first finger follower, the second cam follower means comprises a second finger follower and the engagement means comprises first and second movable fulcrum means on which the first and second finger followers are respectively rockable, wherein the first fulcrum means is movable between a first position in which the first cam follower means is engaged with the first cam and a second position in which the first cam follower means is disengaged from the first cam, and the second fulcrum means is movable between a first position in which the second cam follower means engages the second cam and a second position in which the second cam follower means is disengaged from the second cam, and wherein the first fulcrum means is in the first position thereof and the second fulcrum means is in the second position thereof whilst the drive mechanism is in the first operating condition, the second fulcrum means is in the first position thereof whilst the drive mechanism is in the second operating condition, and both of the first and second fulcrum means are in the second positions thereof whilst the drive mechanism is in the third operating condition.

Preferably the first fulcrum means is in the first position thereof whilst the drive mechanism is in the second operating condition.

In a first embodiment the first and second finger followers are pivotally mounted at one end thereof on a slider member which in use is slidably mounted on or in a member fixed in position relative to an engine cylinder head. The slider could be slidable on a post mounted on an engine cylinder head. This has the advantage of compact packaging. Alternatively the slider could be mounted in a slider defined by a tubular member connected to the cylinder head either directly or via a rocker cover.

Preferably the cylinder head valve means comprises first and second cylinder head valves, which first and second cylinder head valves in the first operating condition are both driven by the first cam, which first and second cylinder head valves in the second operating condition are both driven by the second cam and which first and second cylinder head valves in the third operating condition are both deactivated. Driving two valves (rather than one valve) from a selected one of two different cams decreases size and aids installation.

In a modification of the first embodiment the first finger follower is pivotally mounted at one end thereof on a first slider member and the second finger follower is pivotally mounted at one end thereof on a second slider member, the first and second slider members being slidable on a post and the first slider member being located on the post beneath the second slider member whereby when the second cam follower means is in engagement with the second cam means the second slider member abuts the top of the first slider member and causes the two slider members to move together.

When the cylinder head valve means comprises first and second cylinder head valves then preferably when the cam mechanism is in the first operating condition the first cylinder head valve is driven by the first cam and the second cylinder head valve is deactivated, when the cam mechanism is in the second operating condition both of the cylinder head valves are driven by the second cam and when the cam mechanism is in the third operating condition both of the cylinder head valves are deactivated.

In the first embodiment the slider member or each slider member is preferably provided with lash adjustment means which connects the slider member to the controlled cylinder head valve means. Preferably the slider member or each slider member has a closed bore therein and the lash adjustment means comprises a hydraulic lash adjuster located in the closed bore, the hydraulic lash adjuster having a portion which abuts the top of a valve stem of the cylinder head valve means.

In a second embodiment, the first and second followers are pivotally mounted on a frame member, the frame member being pivotally mounted on a shaft and having lash adjustment means which engages the cylinder head valve means.

In the second embodiment the frame member is preferably pivotally connected to the shaft at a first end thereof and is pivotally connected to the finger followers at the second end thereof remote from the first end, the finger followers extending from the second end of the frame member towards the first end.

In the second embodiment the frame member preferably has an aperture therethrough and the finger followers are pivotally connected to the frame for pivotal motion in the aperture.

Preferably the frame member is engagable with a portion of the camshaft spaced from the first and second cams, the frame member engaging the said portion of the camshaft when the cam mechanism is in the third operating condition.

The portion of the camshaft engaged by the frame member in the third operating condition could be of circular axial cross-section whereby the valve means is deactivated in the third operating condition. Alternatively the portion of the camshaft engaged by the frame member in the third operating condition could have a low lift cam profile.

In a modification of the second embodiment the first finger follower is pivotally mounted on a first frame member and the second finger follower is pivotally mounted on a second frame member, the first and second frame members being pivotally mounted on a shaft, the first frame member being able to pivot about the shaft relative to second frame member, the first frame member engaging a first cylinder head valve of the cylinder head valve means and the second frame member engaging a second cylinder head valve of the cylinder head valve means.

Preferably the first frame member is engagable with a first portion of the camshaft spaced from the first and second cams, the second frame member is engagable with a second portion of the camshaft spaced from the said first portion and spaced from the first and second cams, the first and second frame members respectively engaging the first and second portions of the camshaft in the third operating condition.

In a third embodiment the first and second finger followers are pivotally mounted to an I-shaped frame member, with one finger follower on each side of an elongate central portion of the I-shaped frame member, the I-shaped frame member being pivotally mounted on a shaft at a first end thereof and housing two separate lash adjuster means at the other end thereof for engaging two cylinder head valves.

Preferably the first and second movable fulcrum means each comprises an abutment member for abutting a finger follower and actuator means for moving the abutment member, the actuator means being operable to move each fulcrum means independently of the other fulcrum means. Preferably each abutment member comprises a piston movable in a bore provided in a cylinder head of an engine or in a housing attached to the cylinder head, the piston defining a chamber within the bore and the piston being movable in response to changes in pressure in the chamber. Preferably the cam mechanism comprises supply means for supplying hydraulic fluid to the chamber, which supply means includes switching means for switching the pressure of the hydraulic fluid in the chamber between a first level and a second higher level.

Preferably the first and second finger followers each have a curved lower exterior surface which abuts the fulcrum means.

Preferably the first and second finger followers are held in engagement with the fulcrum means by spring means.

In a second aspect the present invention provides a cam mechanism for controlling the motion of cylinder head valve means of the internal combustion engine, the cam mechanism comprising:

a camshaft having a cam mounted thereon for rotation therewith, a drive mechanism operable to relay drive from the cam to the controlled cylinder head valve means, the drive mechanism comprising cam follower means engageable with the cam and engagement means for engaging the cam follower means with the cam, wherein the cylinder head valve means is activated when the cam follower means is engaged with the cam by the engagement means, the cylinder head valve means being driven by the cam, and the cylinder head valve means is deactivated when the cam follower means is disengaged from the cam by the engagement means and the drive mechanism makes no contact with any part of the camshaft.

Preferably the cam follower means comprises a finger follower and the engagement means comprises a movable fulcrum means on which the finger follower is rockable, the rockable fulcrum means being movable between a first position in which the finger follower is engaged with the cam and a second position in which finger follower is disengaged from the cam.

Preferably the finger follower is pivotally mounted on a slider member which is slidably mounted on or in a member fixed in position relative to a cylinder head, the slider member sliding relative to the member fixed in position when the finger follower is engaged with the cam.

Preferred embodiments of the present invention will now be described with reference to the accompanying drawings in which:

FIG. 3 is a cross-sectional elevational view of the first preferred embodiment of cam mechanism shown in FIGS. 1 and 2, the cam mechanism operating in what will be referred to as the third operating condition;

FIG. 4 is a part cut-away plan view of the first embodiment of cam mechanism illustrated in FIGS. 1 to 3;

Figure 5A:
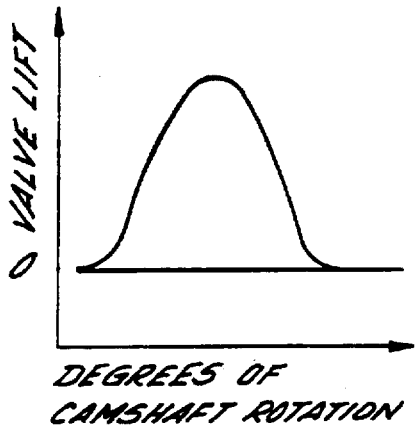
Figure 5B:
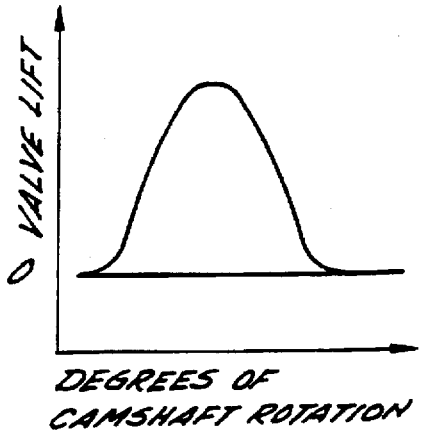
Figure 6A:
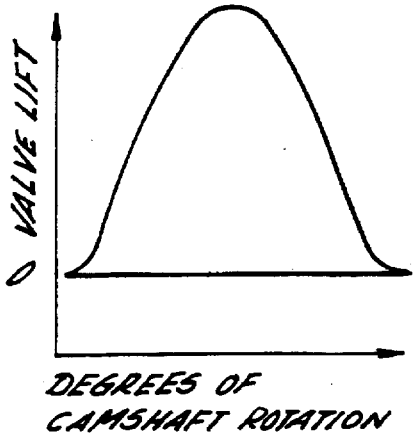
Figure 6B:
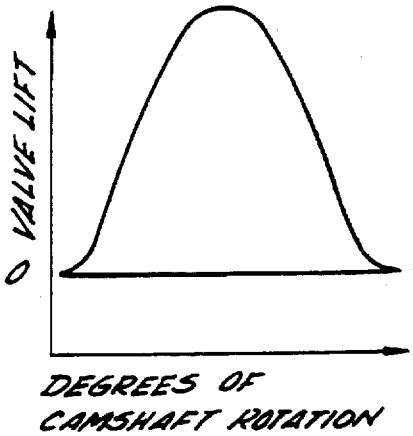
Figure 7A:
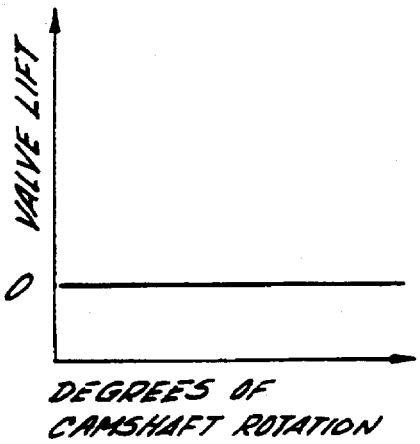
Figure 7B:
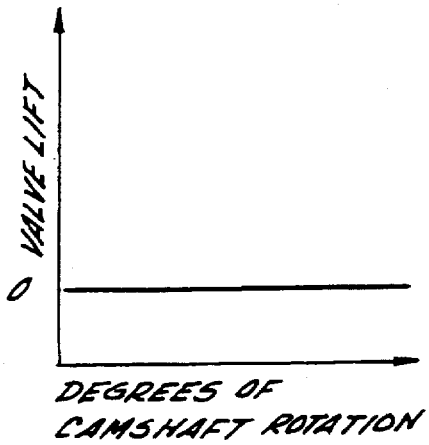
Figure 8:
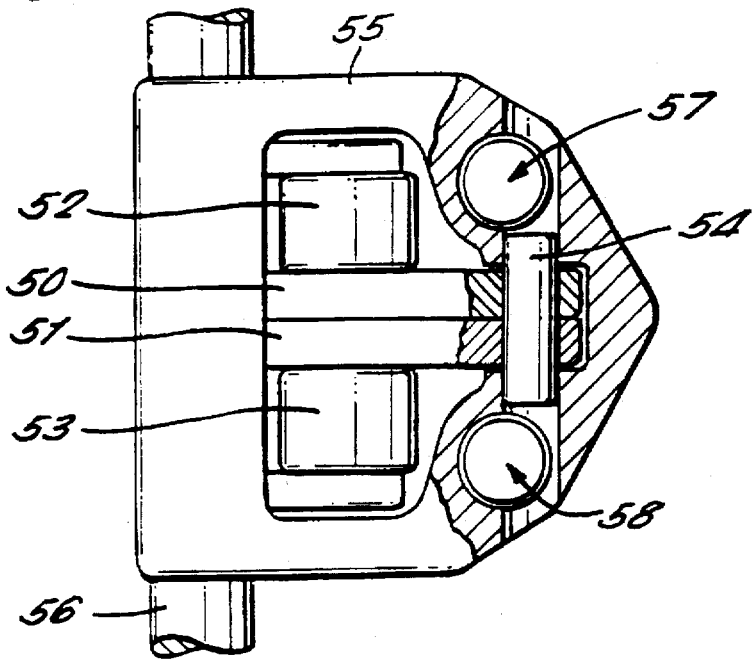
Figure 9:
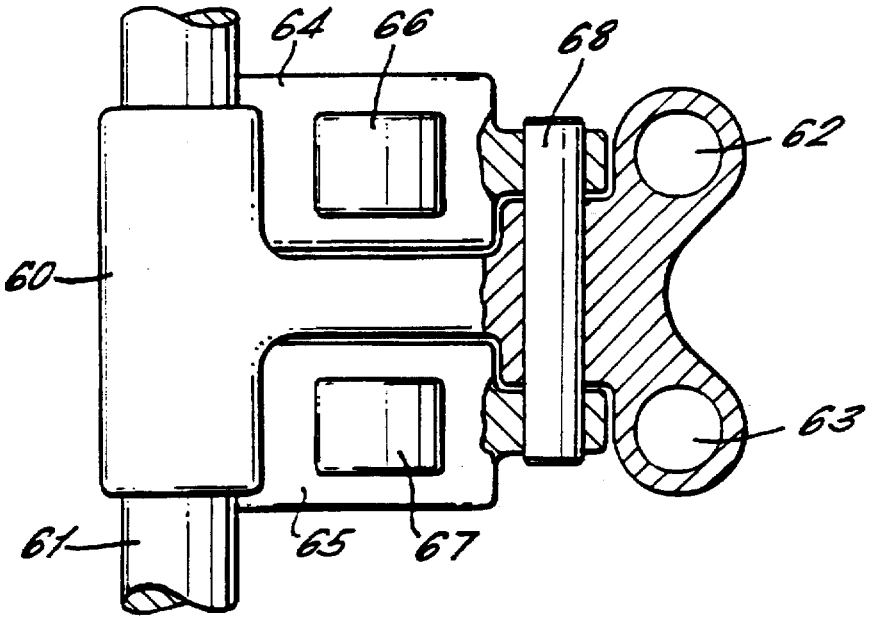
Figure 10:
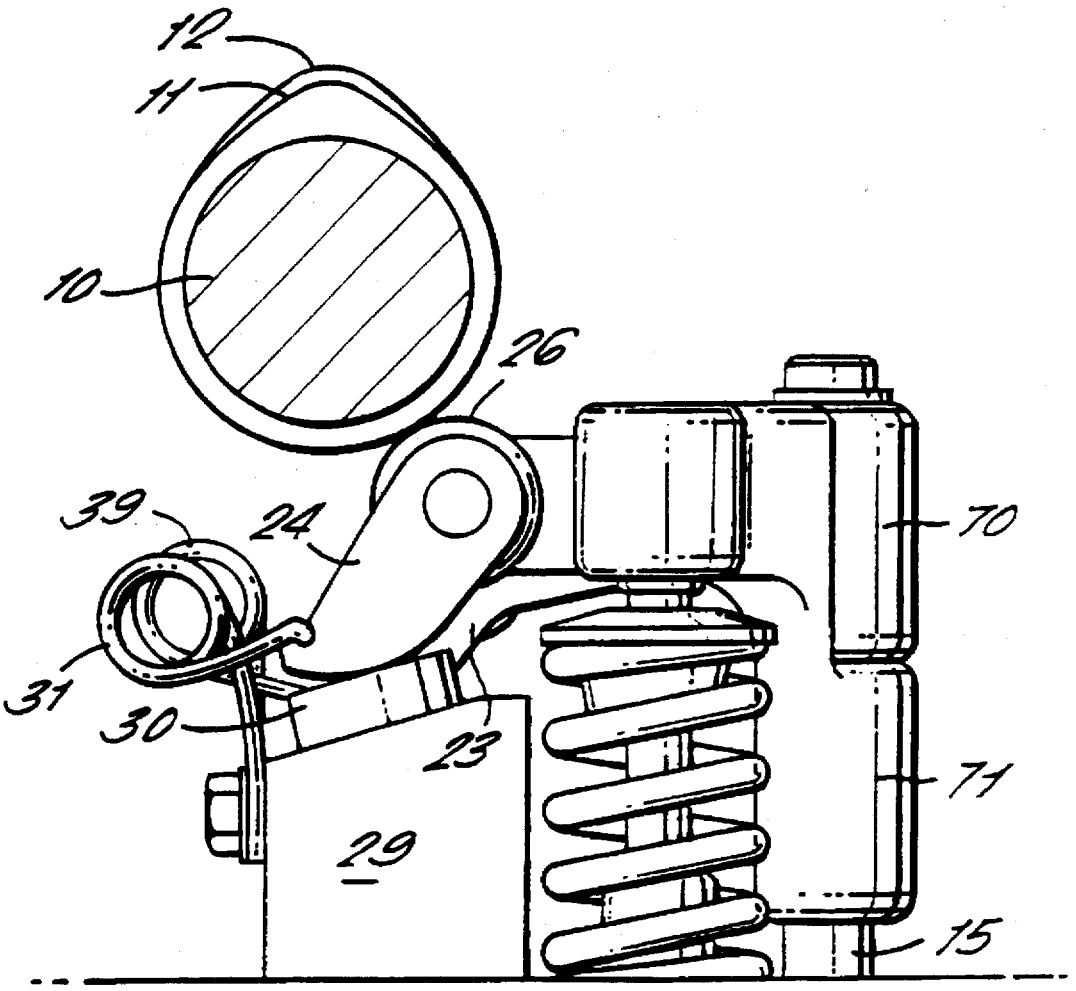
Figure 11:
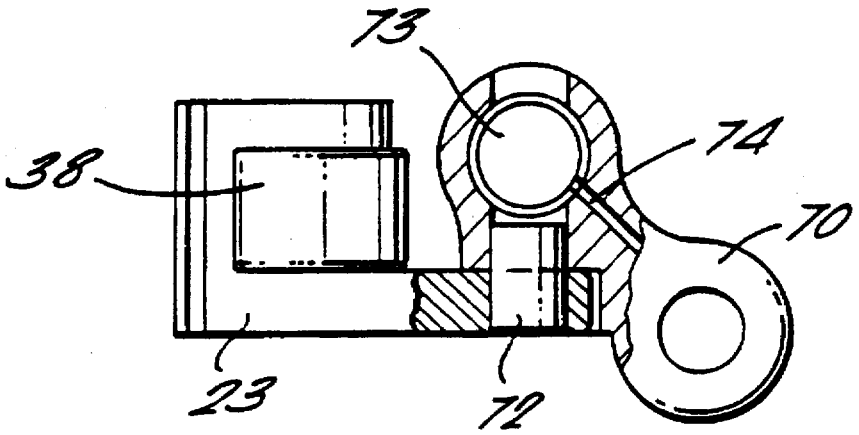
Figure 12:
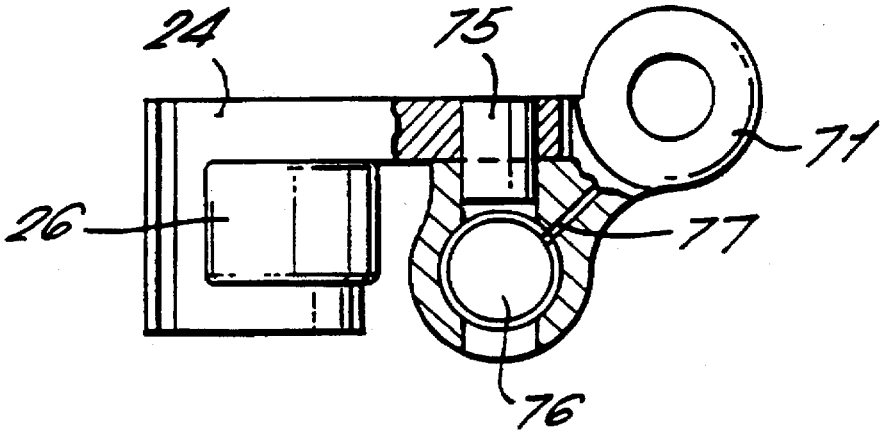
Figure 13A:
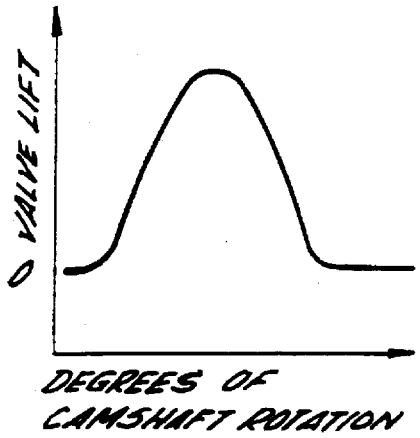
Figure 13B:
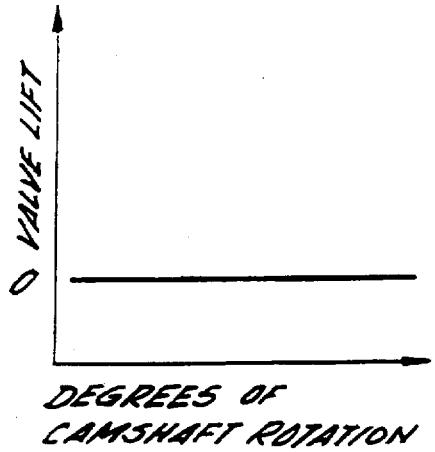
Figure 14A:
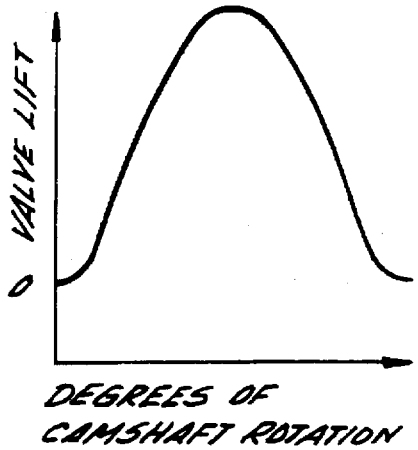
Figure 14B:
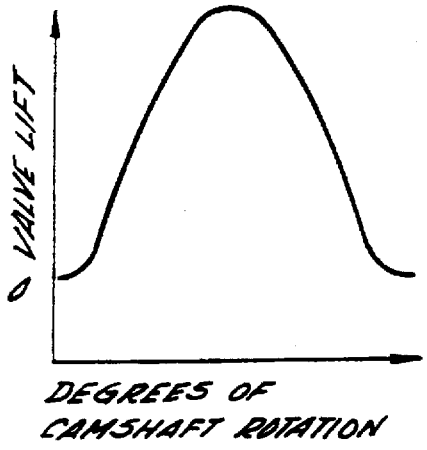
Figure 15A:
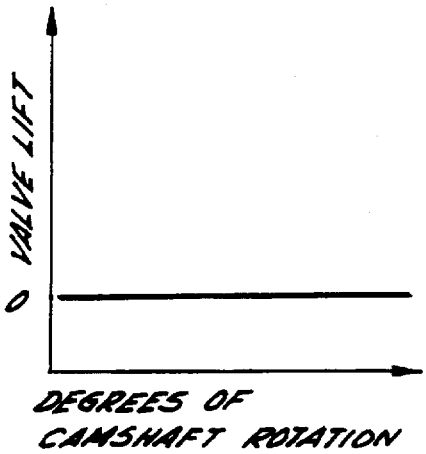
Figure 16:
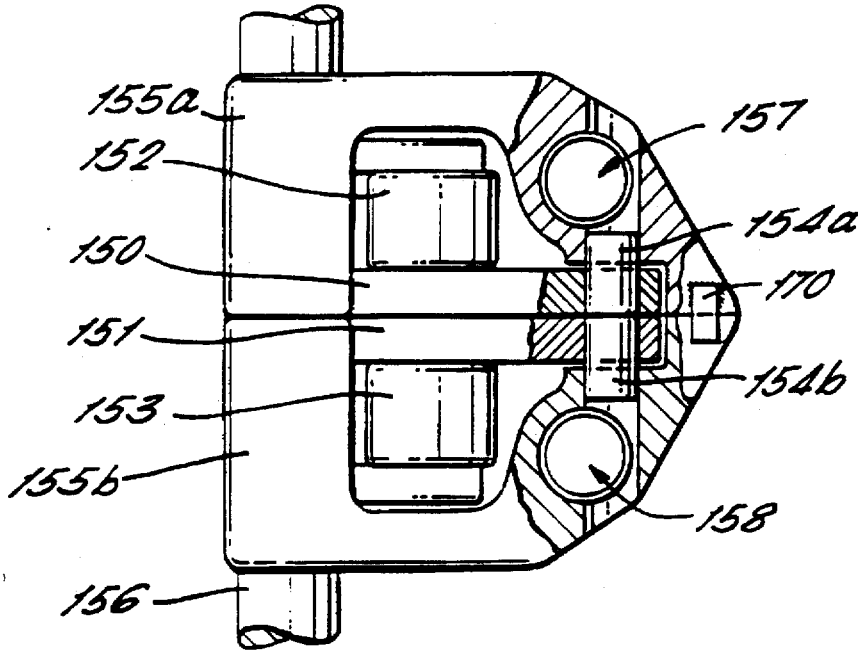
Figure 17:
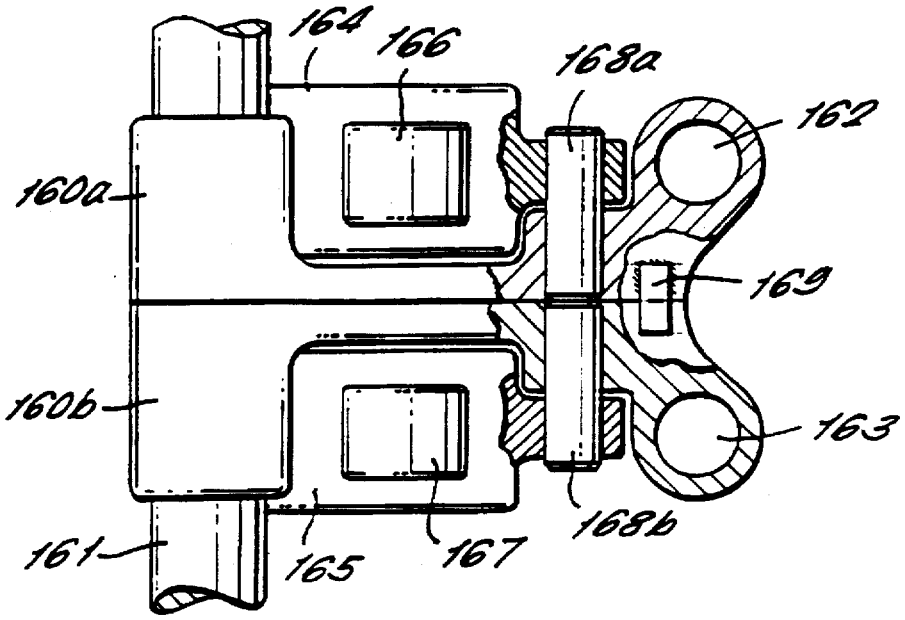
Figure 18A:
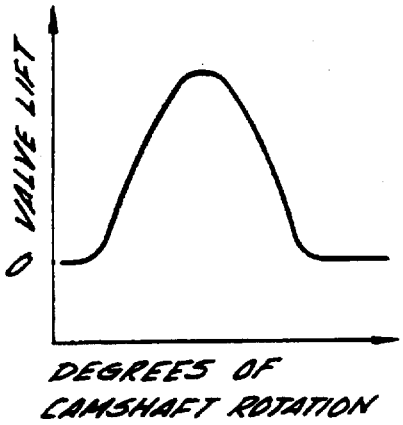
Figure 18B:
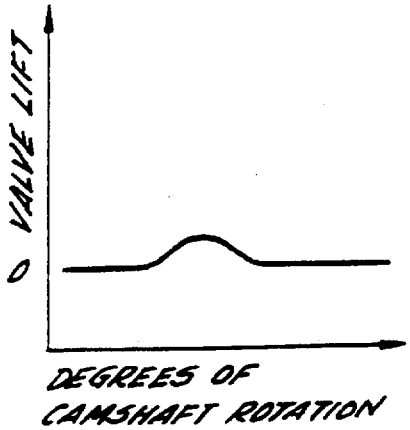
Figure 19A:
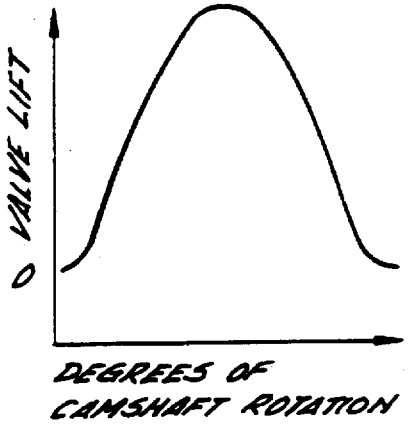
Figure 19B:
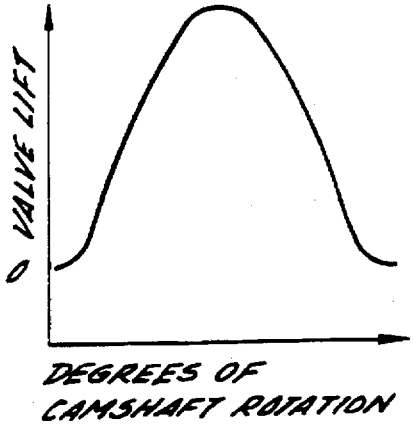
Figure 20A:
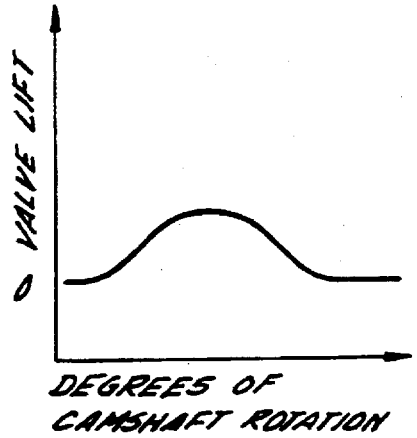

FIGS. 5*a*, 6*a*, 7*a* are graphs which show the motion of a first controlled valve respectively in the first, second and third operating conditions of the cam mechanism, and FIGS. 5*b*, 6*b* and 7*b* show the motion of a second controlled valve respectively in the first, second and third operating conditions of the cam mechanism;

FIG. 8 shows a part cut-away plan view of a second embodiment of cam mechanism according to the invention;

FIG. 9 shows a part cut-away plan view of a third embodiment of cam mechanism according to the invention;

FIG. 10 shows in an elevational view a fourth embodiment of cam mechanism according to the invention which is a modification of the embodiment of cam mechanism shown in FIGS. 1 to 4;

FIGS. 11 and 12 show part cross-sectional plan view of components of the FIG. 10 embodiment;

FIGS. 13*a*, 14*a*, 15*a* are graphs which show the motion of a first controlled valve respectively in the first, second and third operating conditions of the cam mechanism of FIG. 10 and FIGS. 13*b*, 14*b*, 15*b* are graphs which show the motion of a second controlled valve respectively in the first, second and third operating conditions of the FIG. 10 cam mechanism;

FIG. 16 shows in a plan view a fifth emboidment of cam mechanism according to the invention which is a modification of the embodiment of cam mechanism shown in FIG. 8;

FIG. 17 shows in a plan view a sixth embodiment of cam mechanisms according to the invention which is a modification of the embodiment of cam mechanism shown in FIG. 9;

FIGS. 18*a*, 19*a*, 20*a* are graphs which show the motion of a first controlled valve respectively in the first, second and third operating conditions of the cam mechanism of FIG. 16 or FIG. 17 and FIGS. 18*b*, 19*b* and 20*b* show the motion of a second controlled valve respectively in the first, second and third operating conditions of the cam mechanism of FIG. 16 or FIG. 17.

Figure 21:
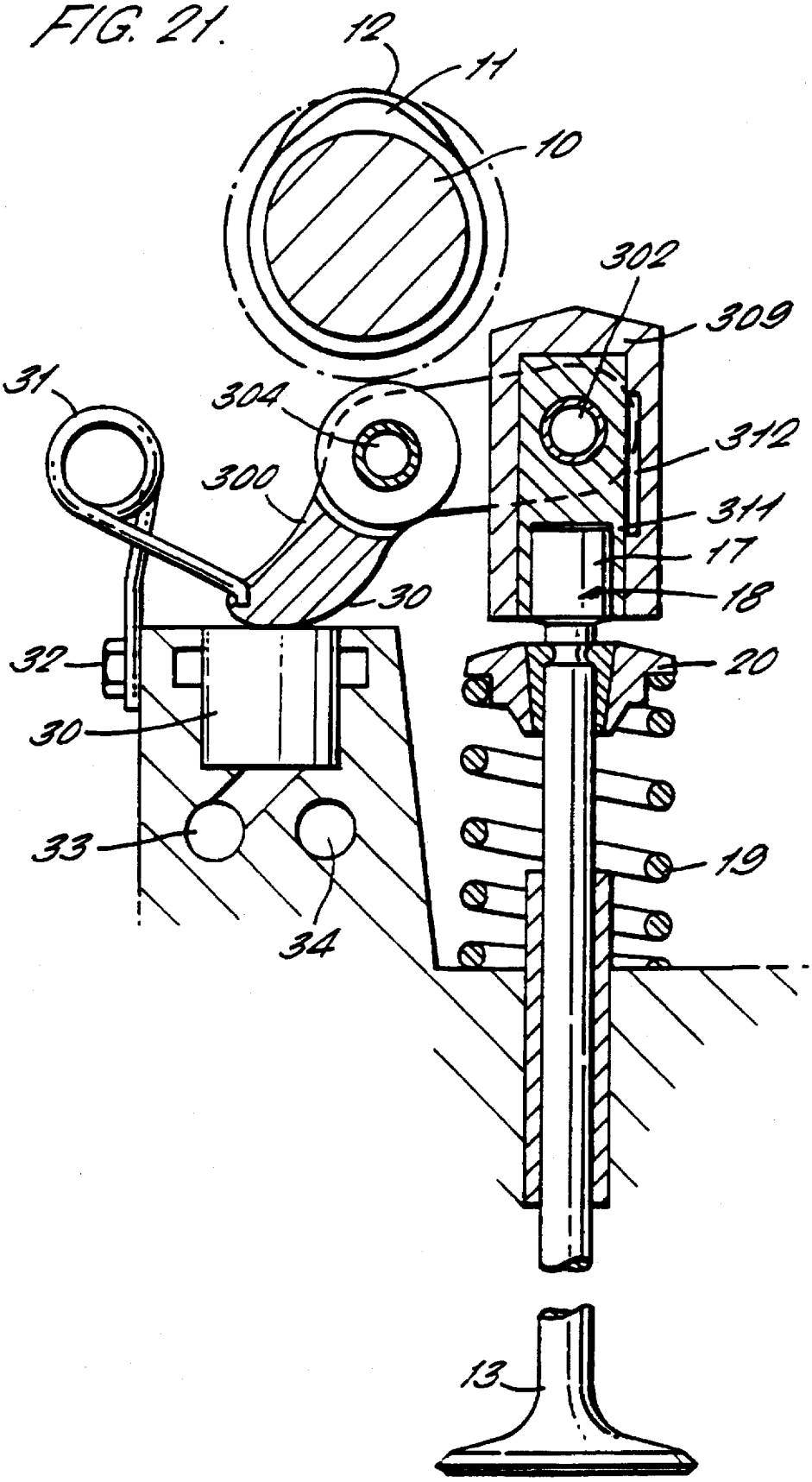
Figure 22:
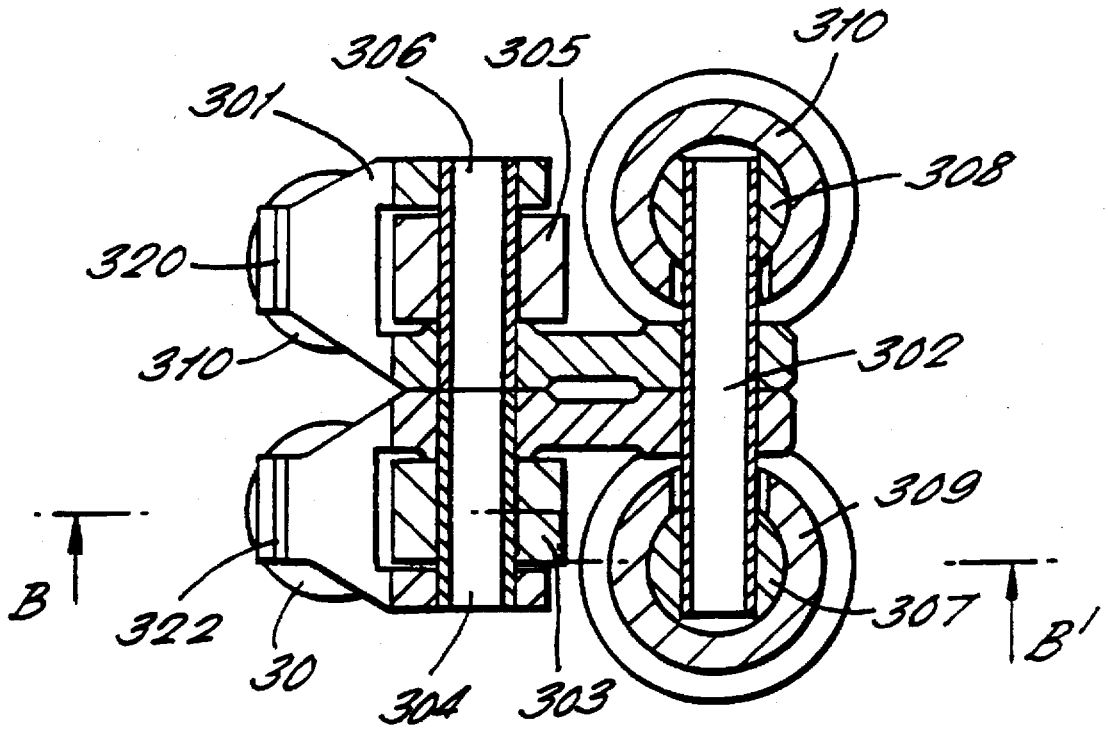
Figure 23:
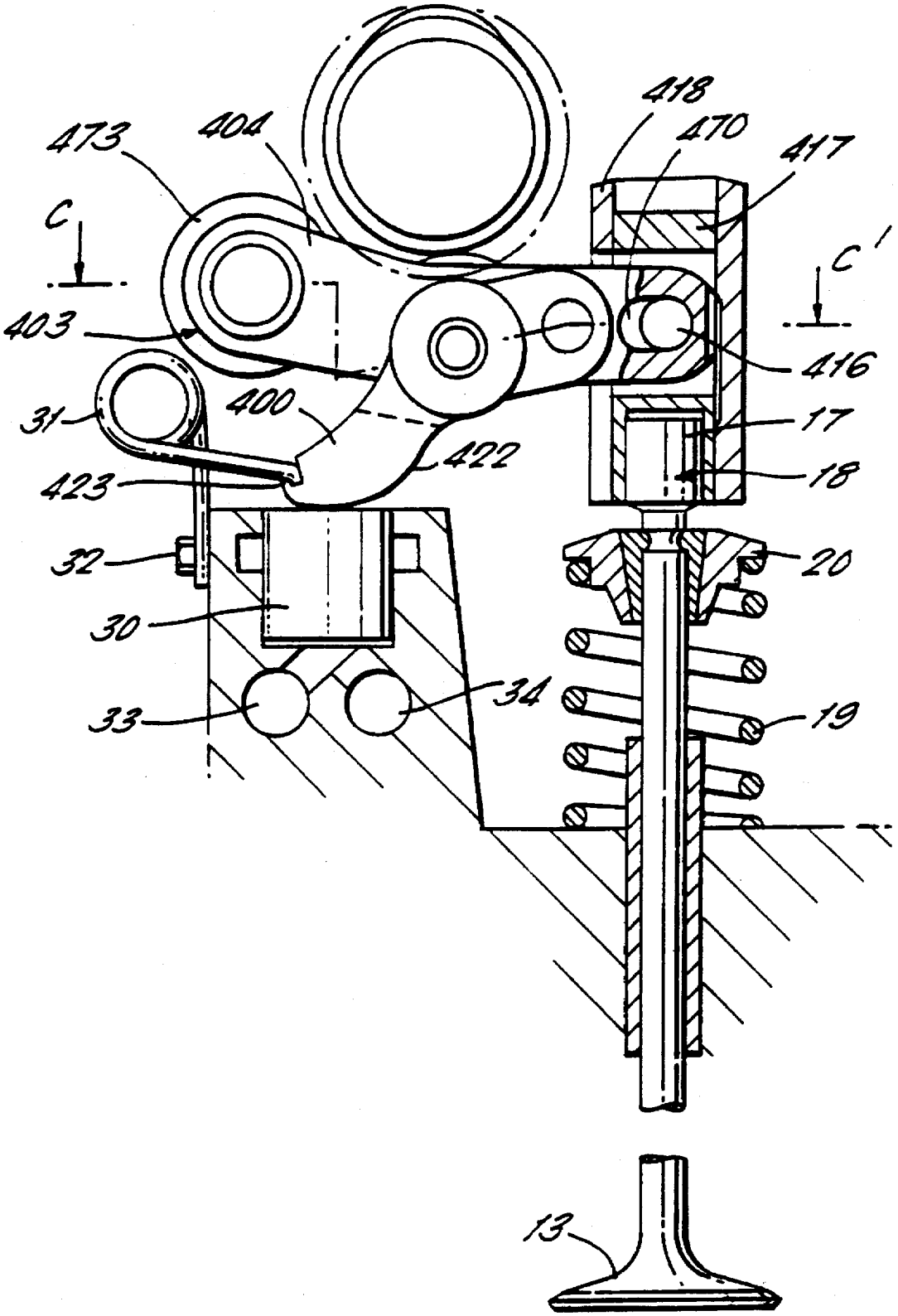
Figure 24:
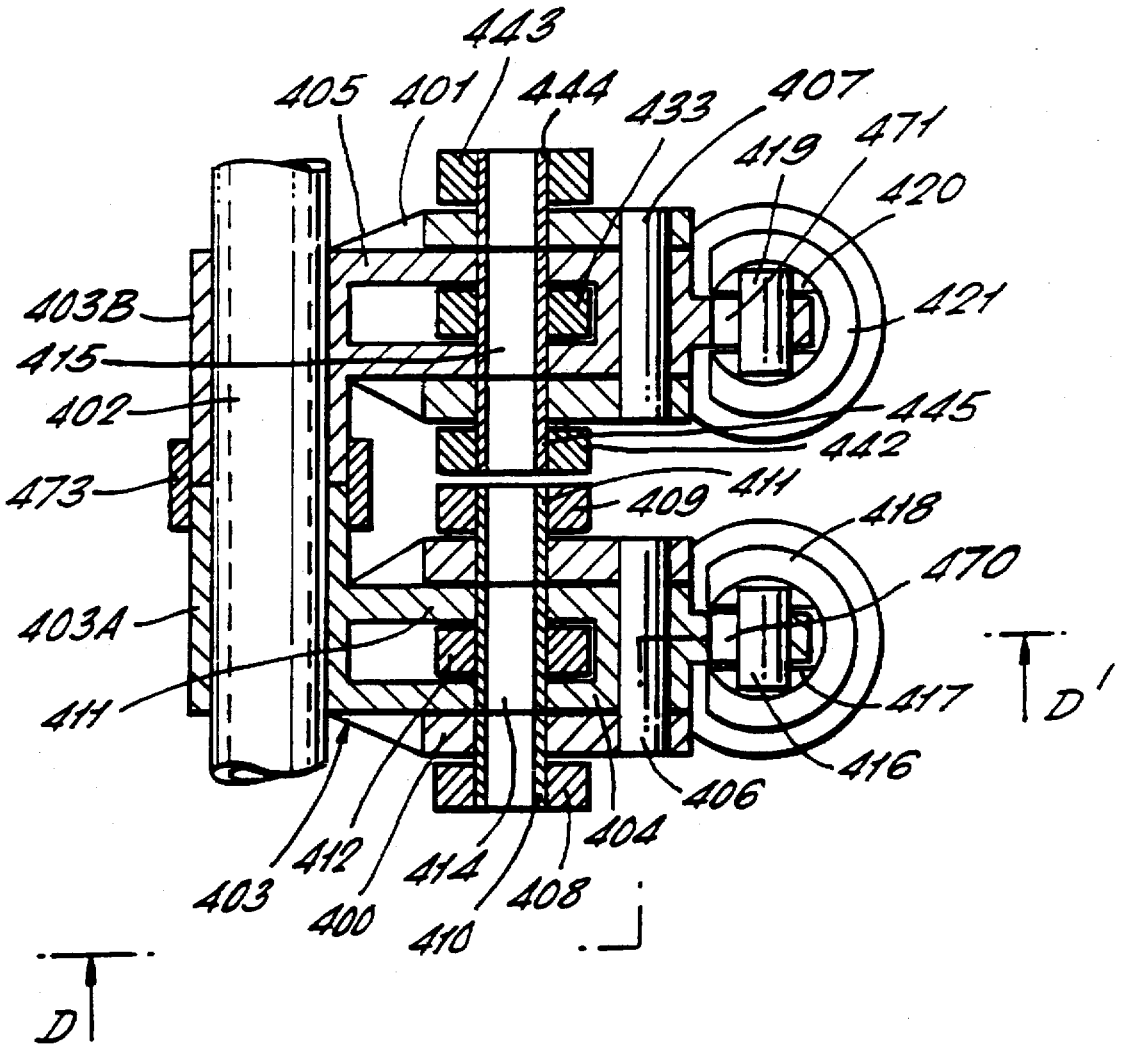

FIG. 21 is a part cross-sectional elevational view of a seventh embodiment of cam mechanism according to the invention in what will be referred to as the third operating condition, the cross-section being taken along the line B—B shown in FIG. 22;

FIG. 22 is a plan cross-sectional view of the FIG. 21 embodiment, the cross-section being taken along the line A—A shown in FIG. 21;

FIG. 23 is a part cross-sectional view of an eigth embodiment of cam mechanism according to the invention, in what will be referred to as the third operating condition, the cross-section being taken along the line D–D' shown in FIG. 24;

FIG. 24 is a plan cross-sectional view of the FIG. 23 embodiment, the cross-section being taken along the line C–C' shown in FIG. 23.

Turning first to FIG. 3 there can be seen in FIG. 3 a camshaft 10 having mounted thereon two cam lobes 11 and 12. The camshaft 10 will be connected by suitable belt and pulley means to the working crankshaft of the engine, so that the camshaft rotates in timed relationship to the rotation of the crankshaft.

In FIG. 3 there can be seen a cylinder head valve 13 which would be the inlet or exhaust valve of the internal combustion engine. The cylinder head 14 of the engine is shown in the FIG. 3 in cross-section.

Fixedly mounted in a bore in the cylinder head 14 is a post 15. Slidable axially on the post 15 is a slider member 16. The slider member 16 can also be seen in the plan view of FIG. 4. The top of the valve stem of cylinder head valve 13 abuts a bucket member 17 of a hydraulic lash adjuster 18 which is provided in a bore in the slider 16. The cylinder head valve 13 is kept in abutment with the bucket member 17 of the hydraulic lash adjuster 18 by a spring 19 which acts between the cylinder head 14 and a spring retainer 20 which is attached to the valve stem of the valve 13. A circlip 40 is provided on the post 15 to limit upward motion of the slider member 16. The circlip 40 is positioned to define a base circle position for the slider member 16 (ie. the position of the slider member 16 when either a finger follower 23 or finger follower 24 is in engagement with the base circle portion of a cam; see later). The provision of the circlip gives the lash adjuster 18 an abutment to act against in a valve deactivated condition (see later).

The cam mechanism of the invention is designed to operate two cylinder head valves simultaneously. This is illustrated in FIG. 4 where it can be seen that the hydraulic lash adjuster 18 has a counterpart 21 also provided in a bore in the slider 16.

Situated between the two hydraulic lash adjusters 18 and 21 is a shaft 22 which is retained in the slider 16.

Rotatable about the shaft 22 are two finger followers 23 and 24.

Both finger followers 23 and 24 are mirror images of each other and therefore we will only describe in detail the finger follower 24 which can be seen in both FIGS. 3 and 4.

The finger follower 24 comprises a first end portion which has a bore therethrough through which passes the shaft 22. The finger follower 24 then has a U-shaped portion at the other end thereof, a shaft 25 extending between the two arms of the U-shaped portion of the finger follower 24 and a roller follower 26 being mounted on the shaft 25. The lower portion of the U-shaped part of the finger follower 24 is provided with a curved exterior surface 27. The exterior surface of the finger follower 24 is also provided with an upwardly facing groove 28.

Provided on top of the cylinder block 14 is a housing 29 in which a piston 30 is movable in a bore between an extended uppermost position and a retracted lowermost position. The finger follower 24 engages the piston 30, the curved lower exterior surface 27 of the finger follower 24 abutting the top of the piston 30. A spring 31 is attached to the housing 29 by means of a suitable nut 32. The spring 31 engages the groove 28 in the finger follower 24 and acts between the finger follower 24 and the housing 29 to keep the finger follower 24 engaged with the top surface of the piston 30.

A second piston will be provided in the housing 29, spaced apart from piston 30. The second piston will be engaged by a lower surface of the finger follower 23. The second position will also be movable between an extended uppermost position and a retracted lowermost position.

The piston 30 is part of a first fulcrum arrangement for the finger follower 24 and the second piston (not shown) is part of a second fulcrum arrangement for the finger follower 23. Each fulcrum arrangement will have a latch arrangement for maintaining its piston in its uppermost position. Latch arrangements are not shown in the figures for the sake of clarity. Suitable latch arrangements have been shown in the PCT patent publication WO91/12415 and also in the UK patent application GB-A-2272022.

In FIG. 3 there can be seen an oil gallery 33 which supplies oil to the bottom face of the piston 30. Also seen in FIG. 3 is an oil gallery 34 which will supply oil to the bottom face of the piston 30 which abuts the finger follower 23.

The hydraulic lash adjusters 18 and 21 in the slider 16 are supplied with oil respectively via oil passages 35 and 36 in the slider member 16 which are in turn supplied by an oil passage which extends axially of the post 15 and which is fed by an oil gallery 37 in the cylinder head 14.

The pressure of the oil in the oil galleries 33 and 34 will be controlled by an electro-mechanical valve (not shown) which in turn is controlled by an electronic controller. The electro-mechanical valve will be able to switch the pressure in each of the oil galleries 33 and 34 independently between a low oil pressure and high oil pressure.

In FIG. 3 the third operating condition of the cam mechanism of the invention is shown and in this operating condition the oil pressure in both of the oil galleries 33 and 34 is kept low. The oil pressure is not sufficient to force the piston 30 upwardly against the biasing force of spring 31. Similarly, the oil pressure in the oil gallery 34 is not sufficient to force upwardly the piston which abuts the finger follower 23.

In the third operating condition the roller follower 26 of the first finger follower 24 does not engage the first cam 11. Also, a second roller follower 38 provided for the finger follower 23 does not engage the second cam 12. Since neither cam 11 nor cam 12 are engaged by the finger followers, no lift is transmitted by the cam mechanism and the valve 13 remains deactivated. The third operating condition is illustrated by the FIGS. 7*a* and 7*b*.

FIG. 7*a* shows that no lift is applied to the valve 13 when the cam mechanism is in the first operating condition. FIG.

7b similarly shows that no lift is applied to the other valve of the controlled pair of valves when the cam mechanism is in the third operating condition.

In the third operating condition the slider member 16 is held in abutment with the circlip 40.

Figure 1:
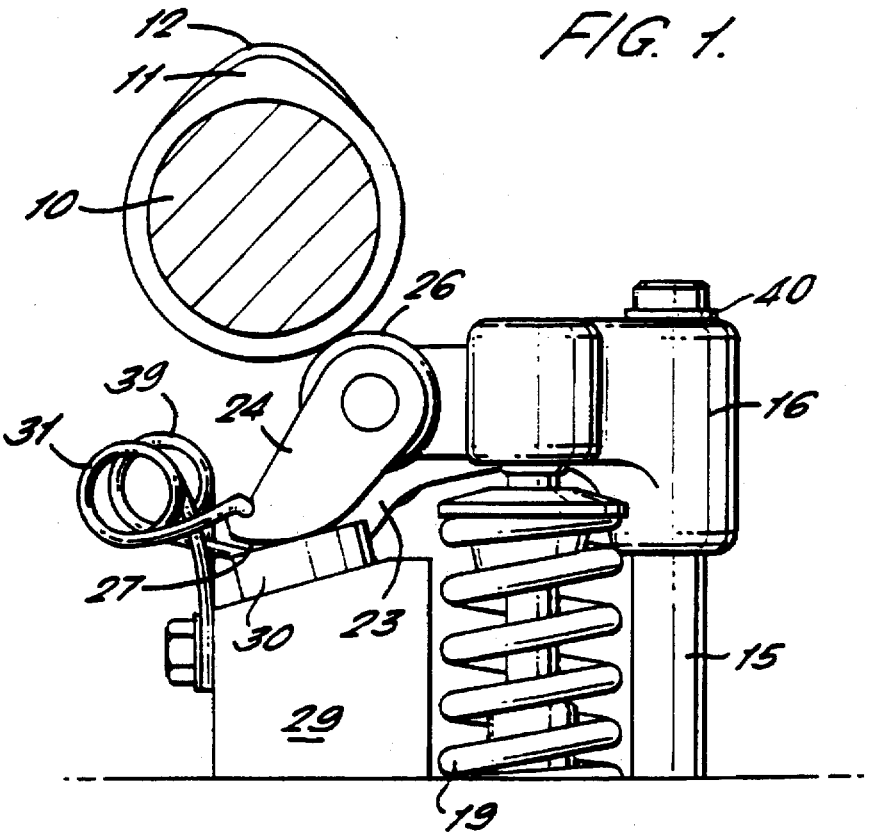
FIG. 1 shows an elevational view of a first embodiment of cam mechanism according to the invention, the cam mechanism operating in what will be referred to as the first operating condition.

When the oil pressure in oil gallery 33 is switched to high oil pressure, whilst the oil pressure in gallery 34 is kept low, the cam mechanism assumes the first operating condition shown in FIG. 1. In FIG. 1, the finger follower 23 can be clearly seen in elevation as can a spring 39 which acts between the housing 29 and the finger follower 23 to keep the finger follower 23 engaged with a top surface of a piston (not shown) which corresponds to piston 30.

The oil pressure in gallery 33 is sufficient to move the piston 30 against the biasing force of spring 31 to a raised position in which the roller follower 26 engages the profile of the cam 11. The piston 30 will be locked in this position by a latching mechanism (not shown). It will be seen that the finger follower 24 has in fact pivotted about the shaft 22 to a position in which the roller follower 26 engages the cam 11.

In the first operating condition shown in FIG. 1 a finger follower 24 pivots about the piston 30 under the action of the cam 11. This is allowed by the curved nature of the lower exterior surface 27 of the first finger follower 24. The pivotting of the finger follower 24 under the control of the cam 11 causes the slider 16 to move reciprocably up and down the post 15, against the biasing force of the spring 19. This in turn causes motion of the valve 13 and activates the valve. The valve 13 in this operating condition follows the profile of low lift cam 11.

FIG. 5a shows the low and short duration lift applied to the valve 13 when the cam mechanism is in the second operating condition. FIG. 5b shows that identical lift is applied to the other of the pair of valves.

Figure 2:
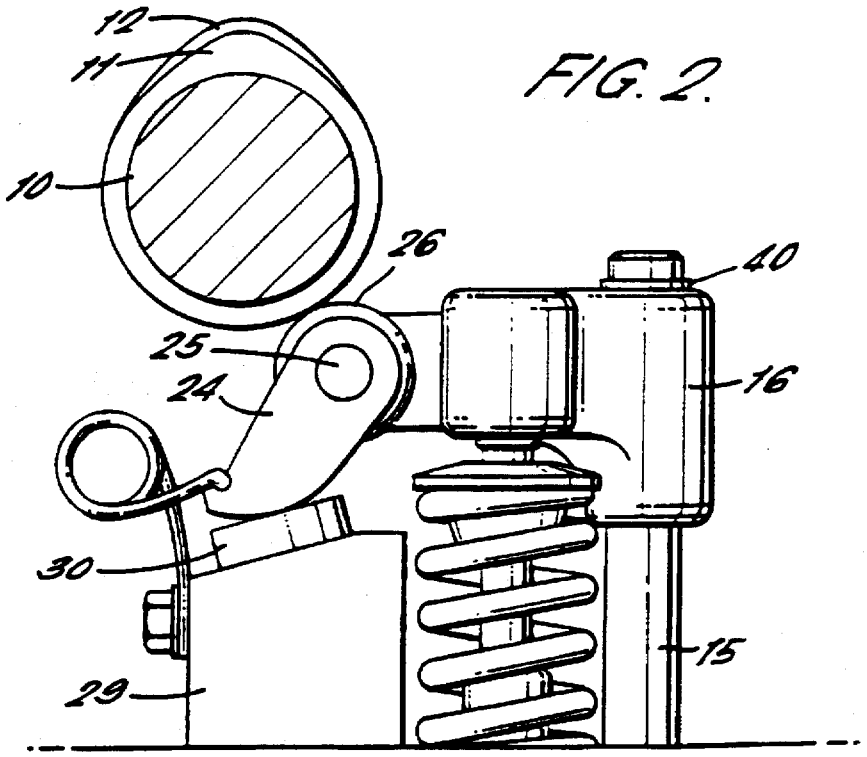
FIG. 2 shows an elevational view of the first embodiment of cam mechanism illustrated in FIG. 1, the cam mechanism operating in what will be referred to as the second operating condition.

The second operating condition of the first embodiment of cam mechanism of the invention is shown in FIG. 2. In the FIG. 2 operating condition the pressure of the oil in both of the galleries 33 and 34 will be kept high and thus the fulcrum means for roller follower 38 will be located in its uppermost position by latching means and the roller follower 38 engages the cam 12, whilst the roller follower 26 still engages the cam 11. The finger follower 24 will pivot about the piston 30 and a finger follower 23 will pivot about the piston engaged thereby.

In the FIG. 2 operating condition, the slider 16 is caused to reciprocally move up and down the post 15 by the action of the cam 12. Since the cam 12 is a high lift cam and the cam profile of cam 12 completly encompasses the cam profile of cam 11, the motion of the slider 16 and thus the motion of the valve 13 is controlled by the high lift cam 12.

FIG. 6a shows the high and long duration lift applied to the valve 13 when the cam mechanism is in the second operating condition. FIG. 6b shows that identical lift is applied to the other of the pair of valves.

It is envisaged that the cam mechanism of the invention could be used for two valves of an engine which has four cylinder head valves per cylinder.

For a four valve per cylinder engine one cam mechanism could control both inlet valves of one cylinder and another cam mechanism could control both exhaust valves of the cylinder.

When the cam mechanisms are in the deactivated state both inlet and/or both exhaust valves would be deactivated. This would prevent any flow of air or fuel through the cylinder, hence deactivating the cylinder. This would be done for say two cylinders of a four cylinder engine or four cylinders of a six or eight cylinder engine, at low load and speed conditions. The object of this is to make the remaining working cylinders work harder and therefore more efficiently thus improving the overall engine efficiency.

In a mid-range condition of the engine, for mid-range speeds and loads, the cam mechanism will assume the operating condition shown in FIG. 1. In this operating condition, the pair of valves are activated and controlled by the profile of the cam 11, which is a cam suited to low speed and/or load operation.

As the engine speed and/or load increases, the electronic controller may bring the cam mechanism to the operating condition shown in FIG. 2, in which the pair of valves are activated and controlled by the profile of the cam 12. The cam 12 has a high lift profile and one which is suited to high speed and/or high load operation of the engine.

It will be appreciated that the first embodiment is very compact in nature, since it requires only two arms in the form of the finger followers 23 and 24 and the packaging can be made quite compact. It is important to achieve compact packaging since space is limited at the cylinder head of any engine. Also, compact packaging can lead to a saving in the mass of the valve train which cuts down losses.

The second embodiment of cam mechanism according to the present invention is shown in FIG. 8. In FIG. 8 the finger followers 50 and 51 are identical to the finger followers 23 and 24, the finger followers 50 and 51 having roller followers 52 and 53 respectively.

Both of the finger followers 50 and 51 are rotatable about a shaft 54, in a similar manner to the first embodiment. However, the shaft 54 is not positioned in a slider, but is positioned in a D-shaped frame member 55 which is pivotally mounted on a shaft 56. The finger followers 50 and 51 and the roller followers 52, 53 pivot relative to the D-shaped frame member 55 through the aperture in the frame member 55. Two hydraulic lash adjusters 57 and 58 are provided in bores in the frame member 55 and each contact the top of the valve stem of a cylinder head valve. The D-shaped frame member 55 will at two spaced apart points abut circular cross-section portions of a camshaft located thereabove.

The second embodiment of the cam mechanism works in the same way as the first described embodiment. The finger followers 50 and 51 will each be in contact with one of two movable fulcrums and three operating positions of the cam mechanism are possible. With both fulcrums in their lower position, the roller followers 52 and 53 are held out of engagement with the cams of a camshaft located thereabove. The frame member 55 will abut the circular portions of the cam but these will impart no lift to the valves and thus the controlled valves remain inactive. The hydraulic lash adjusters 57 and 58 will not overextend in the valve deactivated condition due to the engagement of the frame member 55 with circular portions of the camshaft. The frictional losses will not be great in the valve deactivated position since the only force acting to force the frame member against the rotating camshaft is the biasing force from weak springs in the hydraulic lash adjusters. If mechanical lash adjustment in the form of shims is used then there will be nearly zero frictional losses.

When the finger follower 51 is raised by the fulcrum means it engages then the roller follower 53 with a low lift cam and motion of the low lift cam is transmitted via the roller follower 53 and the finger follower 51 to the frame 55 and thus to both controlled engine valves.

When both the finger follower 51 and the finger follower 50 are raised by the movable fulcrums beneath then the roller follower 52 will engage a high lift cam. Since the profile of the high lift cam encompasses the profile of the low lift cam, the frame 55 will be moved under the motion of the high lift cam and will cause motion of the two controlled cylinder head valves.

The second embodiment shown in FIG. 8 is not as compact as the first embodiment shown earlier and requires more room at the cylinder head for mounting. Also, the mass of the cam mechanism is higher than the mass of the first embodiment and this is disadvantageous. Nevertheless, the second embodiment will be used in certain circumstances in preference to the first embodiment, where the mounting of a post 15 with associated slider is not possible.

A third embodiment of cam mechanism according to the present invention is shown in FIG. 9. In common with the FIG. 8 embodiment, the FIG. 9 embodiment has a frame 60 rotatable about a shaft 61. The frame has two bores 62 and 63 which receive in use hydraulic lash adjusters which in turn engage the tops of the valve stems of two cylinder head engine valves.

The frame 60 of FIG. 9 is a generally I-shaped. The finger followers 64 and 65 of the FIG. 9 embodiment are not located side by side as in the earlier embodiments, but are spaced apart. Finger followers 64 and 65 are mounted on the outer ends of a shaft 68 which extends through the frame member 60. The central portion of the I-shaped frame 60 will be engageable with a circular portion of a camshaft mounted thereabove (not shown).

The finger followers 64 and 65 respectively have roller followers 66 and 67. Each finger follower 64 and 65 is mounted on one of two movable fulcrums (not shown).

When both of the movable fulcrums are in their lower position, neither roller follower 66 nor roller follower 67 engages a cam of a camshaft. The frame 60 is in engagement with the circular cross-section portion of the camshaft which imparts no lift to the frame 60 and therefore no motion is transmitted to the two controlled cylinder head engine valves; the valves are deactivated.

When the finger follower 65 is raised by the fulcrum beneath then the roller follower 67 is brought into engagement with a low lift cam on a camshaft (not shown). The motion of the low lift cam is then transmitted through the roller follower 67 and finger follower 65 to the shaft 68 and then to the frame 60. The motion is then relayed through the hydraulic lash adjusters in the bores 62 and 63 to the two cylinder head engine valves, which are controlled by the profile of the low lift cam engaged by roller follower 67.

When the fulcrum under finger follower 64 is subsequently raised, the roller follower 66 is brought into engagement with a high lift cam and the motion of the high lift cam is transmitted via the roller follower 66, finger follower 64, shaft 68 and frame 60 to the hydraulic lash adjusters 62 and 63 and then to the two controlled engine valves. The profile of the high lift cam will be chosen to completely envelope the profile of the low lift cam, so that when both fulcrums are raised the motion of the two controlled cylinder head valves is controlled only by the high lift cam.

The FIG. 9 embodiment will be used when the cams on the camshaft are further spaced apart than in the embodiments of FIGS. 1 to 8. However, the arrangement is not as compact as the embodiment of FIGS. 1 to 4 and will be of greater mass.

When the cam mechanism of the third embodiment is in the valve deactivated operating condition frictional losses are reduced to a minimum by having the finger followers 64 out of engagement with the cams. Some frictional losses result from engagement of the frame member 60 with the camshaft, but the only biasing force in the frame member in the valve deactivated state results from the small spring force exerted by the springs in the hydraulic lash adjusters (if mechanical lash adjustment was provided by shims then even this force would not be present). The abutment of the frame member 60 with the camshaft in the valve deactivated condition is necessary to prevent the hydraulic lash adjusters overextending.

FIG. 10 shows how the embodiment illustrated in FIGS. 1 to 4 can be modified to provide greater flexibility. In FIG. 10, the majority of the components are identical to the components already described in FIGS. 1 to 4 and accordingly identical reference numerals have been used.

The difference between the embodiment shown in FIG. 10 and the embodiment shown in FIGS. 1 to 4 lies in the fact that the embodiment of FIG. 10 has two slider members 70 and 71, rather than one slider member as in the embodiment shown in FIGS. 1 to 4.

Two slider member 70 and 71 are both slidable on the same post 15 and have aligned bores therethrough. The slider member 70 is shown in plan part cross-section view in FIG. 11 and in the figure it can be seen that the finger follower 23 is pivotally connected to the slider member 70 by a shaft 72. The finger follower 23 is connected only to the slider member 70 and is not in any way pivotally connected to the other slider member 71.

The slider member 70 has a hydraulic lash adjuster 73 for abutting the top of a first controlled cylinder head valve of a pair of cylinder head valves. The hydraulic lash adjuster is supplied with oil through a passage 74.

In FIG. 12 a plan part cross-section view of the lower slider member 71 can be seen and in the FIG. 12 it can be seen that the finger follower 24 is pivotally connected to the lower slider member 71 and is not in any way pivotally connected to the upper slider member 70. The finger follower 24 is connected to the lower slider member 71 by a shaft 75. A hydraulic lash adjuster 76 is provided in the slider member 71 and the hydraulic lash adjuster is supplied by a passage 77. The hydraulic lash adjuster 76 will abut the valve stem of the second cylinder head valve of the pair of cylinder head valves.

Since the embodiment has two slider members, the modes of operation of the mechanism are different to the embodiments shown in FIGS. 1 to 4. The modes of operation are illustrated in FIGS. 13*a*, 13*b*, 14*a*, 14*b*, 15*a* and 15*b*.

Turning first to FIGS. 13*a* and 13*b*, these figures illustrate the operating condition actually shown in FIG. 10. In FIG. 10 the movable fulcrum 30 is raised to engage the roller follower 26 with the cam surface 11. The slider member 71 will thus move reciprocally up and down the post 15, under the control of the cam 11. The cam 11 is a low lift cam. The motion of the valve controlled by slider member 71 can be seen in FIG. 13*a* in this operating condition.

In the same FIG. 10 operating condition, the other movable fulcrum is kept in its lowermost position so that no motion is tranmitted from the cam 12 to the slider member 70. Consequently, the valve controlled by the slider member 70 remains inactive as can be seen in FIG. 13*b*.

When the roller follower 38 mounted on finger follower 23 is brought up into engagement with the cam 12 by means of the movable fulcrum situated there beneath, the slider member 70 is caused to move by the action of the cam 12. Since the slider member 70 is positioned above the slider member 71, the slider member 70 causes motion also of the slider member 71. Since the lift of the high lift cam 12 is greater than and completely encompasses the lift of the lower lift cam 11, both slider members 70 and 71 follow the profile of the high lift cam 12 and hence both of the controlled cylinder head valves are given high lift. This can be seen clearly in FIGS. 14*a* and 14*b* where the valve motion of both valves is shown.

Figure 15B:
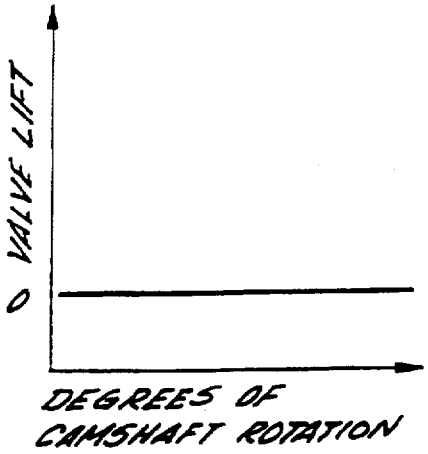

When both of the roller followers 26 and 38 are brought out of contact with their respective cams then no motion is transmitted to either of the controlled valves and this is illustrated in FIGS. 15*a* and 15*b*.

A modification of the FIG. 8 embodiment is shown in FIG. 16. The majority of the components in both embodiments are identical and therefore we will not describe in detail the components of FIG. 16.

The significant difference between the FIG. 16 and FIG. 8 embodiments is the provision in the FIG. 16 embodiment of a frame member which comprises two halves, 155*a* and 155*b*. Also, the shaft 54 in the FIG. 8 embodiment is replaced by two shafts 154*a* and 154*b*. In this way, the frame half 155*b* can move independently of the frame half 155*a* and therefore each valve of a controlled pair of valves can have a different motion to the other. However, a bridging member 170 is attached to the frame half 155*a* which can abut the top surface of the frame half 155*b*. Thus when the frame half 155*a* is displaced downwardly by a cam more than frame half 155*b* then the bridging member 170 abuts top surface of frame half 155*b* and both frame half 155*a* and frame half 155*b* move together.

In a similar manner, FIG. 17 shows a modification of the FIG. 9 embodiment, with the I-shaped frame 60 of the FIG. 9 embodiment replaced by a split frame comprising two halves 160*a* and 160*b*. The shaft 68 is replaced by two shafts 168*a* and 168*b*. In this way, frame half 160*b* can move independently of frame half 160*a* so that each of a controlled pair of valves can move with a different motion to the other. However, a bridging portion 169 is attached to the frame half 160*a* which can abut the frame half 160*b* so that the two halves move together when frame half 160*a* is displaced more than frame half 160*b*.

Each of the frame halves 155*a* and 155*b* will engage separate portions of a camshaft. When both movable fulcrums are in their lowermost position and the roller followers 152 and 153 are out of engagement with their cams, then the cylinder head valve abutting lash adjuster 157 will be controlled by the portion of the camshaft abutted by the frame half 155*a*. Similarly, the cylinder head valve abutted by hydraulic lash adjuster 158 will be controlled by the portion of the camshaft abutted by frame portion 155*b*. In a similar manner, frame portions 160*a* and 160*b* will also abut two different portions of a camshaft and the valves controlled thereby will be controlled in accordance with the shape of the camshaft portions abutted by the two frame halves 160*a* and 160*b*.

The camshaft portions abutted by the frame members could be circular in nature, so that the valves controlled have no lift (as illustrated before). Alternatively, the portions of the camshaft abutted by the frame halves could have some lift and indeed could have lift different to each other.

FIGS. 18*a*, 18*b*, 19*a*, 19*b*, 20*a* and 20*b* show valve motion for either of the embodiments of FIG. 16 or FIG. 17, when the frame halves of either embodiment abut portions of the camshaft which have differing lifts.

FIGS. 18*a* and 18*b* show an operating condition in which a low lift cam is engaged (either by roller follower 153 or roller follower 167, depending on the embodiment), whilst the other roller follower (either 152 or 166) remains out of engagement with the high lift cam. It can be seen from FIG. 18*a* that one controlled valve follows a low lift cam profile. It can be seen from FIG. 18*b* that the other controlled valve follows the very low lift profile of the portion of the camshaft abutted by the frame member 155*a* or 160*a*.

In FIGS. 19*a* and 19*b* there is shown a condition in which a high lift cam is abutted (either by roller follower 152 or roller follower 166). In this case, both controlled valves follow the high lift cam profile, the valve half 155*a* engaging the valve half 155*b* by means of the bridging member 170 or the frame half 160*a* engaging the upper surface of the frame member 160*b* by means of the bridging member 169.

Figure 20B:
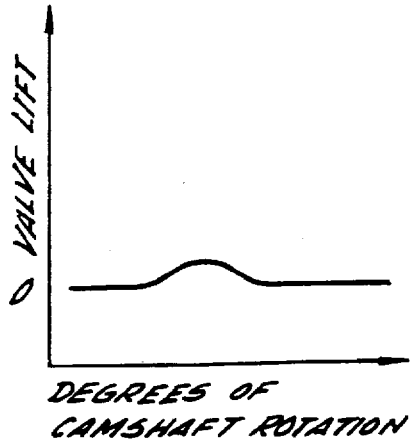

In the operating condition of FIGS. 20*a* and 20*b* the low lift and high lift cams provided on the camshaft are not engaged by either of the roller followers and the two frame halves are running on the camshaft and one valve is controlled by the profile of the portion of the camshaft abutted by the frame members 155*b* and 160*b* (as shown in FIG. 20*a*), whilst the other controlled valve is controlled by the cam profile of the portion of the camshaft abutted by the frame members 155*a* or 160*a* (as shown in FIG. 20*b*).

FIGS. 21 and 22 show a further embodiment of cam mechanism according to the invention. The principle of operation of the mechanism is the same as described above for the earlier embodiments, but the packaging is different. Many components are also identical with earlier described components and will be given identical reference numerals. We shall concentrate on the differences between the embodiment of FIGS. 21 and 22 and earlier embodiments.

In FIG. 21 the finger followers 300 and 301 are similar to finger followers 23 and 24 in that they have a bore through which a shaft 302 passes and each have a U-shaped section. In between the arms of the U-shaped section of finger follower 300 a roller follower 303 is mounted on a shaft 304 which is secured in the arms. In between the arms of the U-shaped section of finger follower 301 a roller follower 305 is mounted on a shaft 306 which is secured in the arms. The finger follower 300 has a curved lower face 307 for abutting the top of the piston 30 and the finger follower 301 has a similar surface (not shown) for abutting the top of a further piston 310. The spring 31 locates in a groove 322 on the top of finger follower 300 and a similar spring (not shown) will locate in a groove 320 in the top of finger follower 301, the springs acting to hold the finger followers 300 and 301 in abutment with the pistons 30 and 310.

The two finger followers 300 and 301 abut along facing side but are free to move relative to each; the shafts 304 and 306 are not joined.

The main difference between the embodiment of FIGS. 21 and 22 and the embodiment of FIGS. 1–4 lies in the fact that in the FIGS. 21 and 22 embodiment the finger followers 300 and 301 are mounted to pivot on a shaft 302 which spans between two sliding members 307 and 308 which are slidable inside two cylinders defined at the cylinder head of the engine by tubular members 309 and 310. The tubular members 309 and 310 can, for instance, be formed either as part of the rocker cover of the engine or are preferably formed integrally with the cylinder head. The tubular members 309 and 310 each define a cylinder partially closed at one end with outlet passages (not shown) allowing communication of each cylinder with the exterior of the tubular members 309 and 310 in order to prevent a hydraulic lock forming (alternatively the tubular members could each have an open bore extending therethrough with circlips acting as a stop for the slider members within the bores). In each cylinder there is located one of the sliding members 307 or 308. Each sliding member 307 or 308 has a closed bore in which a hydrualic lash adjuster such as 18 (see FIG. 21) is located. Each hydraulic lash adjuster abuts the top of a stem of controlled valve (e.g. lash adjuster 18 abuts the top of the valve 13). The hydraulic lash adjusters will be supplied with oil via passages in the sliding members 307 or 308 and passages in the tubular members 309 and 310; e.g. the lash adjuster 18 is supplied with oil via a passage 311 in the sliding member 309 which is in turn supplied with oil from a gallery 312 in the tubular member 309.

The embodiment of FIGS. 21 and 22 works in the same way as the embodiment of FIGS. 1 to 4. If both roller followers 303 and 305 are out of contact with cams 11 and 12 then the two controlled valves (only 13 shown) remain deactivated. If the roller follower 303 contacts cam 11 whilst the roller follower 305 remains out of contact then both the controlled valves receive low lift from the cam 11 via the roller follower 303, the finger follower 300, the shaft 302 and the sliding members 307 and 308 (with their respective lack adjusters). If both roller followers 303 and 305 are in the raised positions then both controlled valves will be controlled by the high lift of cam 12 transmitted through the roller follower 305, the finger follower 301 and the sliding members 307 and 308 (with their respective lash adjusters). The partially closed ends of the cylinders in the tubular members 309 and 310 define end stops for the sliding members 307 and 308 and give the lash adjusters references to work from (alternatively circlips in open bores could provide the references).

The embodiment of FIGS. 23 and 24 is similar in many ways to the earlier embodiments and identical components will be given identical reference numerals.

The finger followers 400 and 401 of the embodiment of FIGS. 23 and 24 are each identical and are each U-shaped. The finger followers 400 and 401 are both pivotally mounted on a U-shaped frame 403 which is pivotally mounted on a shaft 402, with the arms of the U-shaped frame extending away from the shaft 402 towards the controlled valves (e.g. 13). The U-shaped frame 403 is symetrically split in a direction transverse of the shaft 402 into two halves 403A and 403B, each half being pivotal about the shaft 402 independently of the other. One arm 404 of the U-shaped frame 403 is interposed between two arms of finger follower 400 and the other arm 405 is interposed between the two arms of the finger follower 401. A shaft 406 extends through the arm 404 of the U shaped member and the two arms of the finger follower 400 to link them all together. A shaft 407 extends through the arm 405 of the U shaped member and the two arms of the finger follower 401 to link them all together.

Two roller followers 408 and 409 are rotatably mounted on the finger follower 400, on the exterior sides of the finger follower 400, two half shafts 410 and 411 being rotatably mounted one in each of the arms of the finger follower 400, extending outwardly. In a similar fashion two roller followers 442 and 443 are rotatably mounted on the finger follower 401, on the exterior sides of the finger follower 401, two half shafts 444 and 445 being rotatably mounted one in each of the arms of the finger follower 401 extending outwardly.

The arms 404 and 405 of the U-shaped frame 403 are each provided with a central cut out portion in which a roller follower is mounted on a shaft extending through the arm (roller follower 412 is mounted on a shaft 414 in the arm 404 and roller follower 433 is mounted on a shaft 415 in the arm 405).

The arm 404 is pivotal about a shaft 416 at the end of the arm furthest distance from shaft 402. The shaft 416 is mounted on a slider member 417 slidable in an open bore in a tubular member 418 which is either part of the rocker cover or preferably part of the cylinder head. In the slider member 417 a lash adjuster 18 is provided which abuts the top of the controlled valve 13. The shaft 416 is slidable in a slot 470 provided in the arm 404, the slot 470 being necessary to allow relative motion between the arm 404 and shaft 416 when the arm 404 pivots about shaft 402.

The arm 405 is pivoted about a shaft 419 at the end of the arm 404 furthest distance from the shaft 402. The shaft 419 is mounted in a slider member 420 which is slidable in an open bore defined in a tubular member 421 which is either part of the rocker cover or preferably part of the cylinder head. In the slider member 420 a lash adjuster (not shown) is provided which abuts the top of the stem of a controlled valve (not shown). The shaft 419 is slidable in a slot 471 (see FIG. 24) provided in the arm 405, the slot 471 being necessary to allow relative motion between the arm 405 and the shaft 419 when the arm 405 pivots about shaft 402.

The finger follower 400 has a curved lower surface 422 which abuts the top of the piston 30 and which allows the finger follower 400 to pivot about the top of the piston 30. The finger follower 400 is held in abutment with the piston 30 by the spring 31 which engages a groove 423 provided in the upper surface of the finger follower 400. In a similar fashion the other finger follower 401 has a curved lowermost surface (not shown) which abuts the top of a piston (not shown) and the finger follower 401 is held in engagement with the other piston by a spring (not shown) engaged with a groove (not shown) in the top surface of the finger follower 401.

When both of the pistons in the cylinder head are in their lowest positions the roller followers 408 and 409 of the finger follower 400 and the roller followers 443 and 442 of finger follower 401 are all out of engagement with the cams on the camshaft 10. The roller followers 412 and 433 mounted in the arms 403 and 404 of frame 403 engage the camshaft 10. If the roller followers 412 and 413 engage a circular portion of the camshaft 10 then the slider members 417 and 420 remain still and the controlled valves (e.g. 13) inactive. However, if the roller followers 412 and 433 engage cams on the camshaft 10 then the arms 404 and 405 will relay motion to the slider members 412 and 420 which will slide and cause valve motion. Since the U-shaped frame 403 is split into two halves (403A and 403B) the arm 404 can engage a cam of different lift to the cam engaged by arm 405 and thus arm 404 can move relative to are 405 so that the arms 405 and 404 transmit different lifts to the two controlled valves.

When the piston 30 is raised the roller followers 408 and 409 of the follower 400 are brought into engagement with two cams of indentical profile on the camshaft 10. If the other piston remains lowered then the valve 13 will be controlled by the lift of the cams engaged by the follower followers 408 and 409, whilst the valve controlled by the piston remains under control of the roller follower 433 following a circular piston of the camshaft 10 or a cam of low lift.

When the piston 30 is raised and the other piston is raised then a further mode of operation is occasioned. A dog clutch 473 is provided as a cross=linking arrangement which does not allow the arm 405 to move downwardly further than arm 404 by acting between the two halves 403A and 403B of the frame member 403 where they abut on the shaft 402. Alternatively cross linking could be provided by a bar extending across from arm 405 to abut the top surface of arm 404. When the roller followers 442 and 443 of the arm 405 engage cams of higher lift than the cams engaged by the roller followers 408 and 409 of arm 404 then the controlled valves will both be given the same lift, a lift dictated by the higher lift cams engaged by the roller followers 442 and 443.

The lash adjuster 18 and the other lash adjuster (not shown) will both be supplied by oil through the tubular members 418 and 421 and the slider members 417 and 420. The lash adjusters use as a reference for adjustment the abutment of the roller followers 412 and 433 with the cam shaft 10.

The use of slider members which slide inside a cylinder (see FIGS. 21 to 24) rather than on posts (see FIGS. 1 to 4) has the advantage of a potentially lighter reciprocating mass. Also machining of bores to form the cylinders is a relatively simple machining operation which can be done when the bores for the valves are machined in the cylinder head achieving instant alignment between the sliders and the controlled valves.

All of the above embodiments share very important advantages in that three operating conditions are provided with just two movable fulcrums and in that neither of the roller followers contact their respective cams in the valve deactivated operating condition. Thus no valve train friction is incurred at all and this reduces engine losses.

We claim:

1. A cam mechanism for controlling the motion of cylinder head valve means of an internal combustion engine, the cam mechanism comprising:

a camshaft having first and second cams which rotate therewith, the first having a cam profile which imparts a first lift and the second cam having a cam profile which imparts a second higher lift, and a drive mechanism operable to relay drive from the first or the second cam to the controlled cylinder head valve means, the drive mechanism comprising first and second cam follower means engageable respectively with the first and second cams and engagement means for engaging the first and second cam follower means with their respective cams, the cylinder head valve means further comprising first and second cylinder head valves, said drive mechanism having three operating conditions;

(a) a first operating condition in which the first cam follower means is engaged with the first cam and the first cylinder head valve is driven by the first cam, (b) a second operating condition in which the second cam follower means is engaged with the second cam and the first and second cylinder head valves are both driven by the second cam; and (c) a third operating condition in which both the first and second cam follower means are disengaged from the first and second cams, wherein in the first operating condition, the first cylinder head valve receives a lift different from the lift received by the second cylinder head valve.

2. A cam mechanism as claimed in claim 1 wherein the first and second cylinder head valves are both deactivated in the third operating condition.

3. A cam mechanism as claimed in claim 1 wherein the second cylinder head valve is deactivated in the first operating condition.

4. A cam mechanism as claimed in claim 1 in which the first cam follower means comprises a first finger follower, the second cam follower means comprises a second finger follower, and the engagement means comprises first and second movable fulcrum means on which the first and second finger followers are respectively rockable, wherein the first fulcrum means is movable between a first position in which the first cam follower means is engaged with the first cam and a second position in which the cam follower means is disengaged from the first cam, and the second fulcrum means is movable between a first position in which the second cam follower means engages the second cam and a second position in which the second cam follower means is disengaged from the second cam, and wherein the first fulcrum means is in the first position thereof and the second fulcrum means is in the second position thereof while the drive mechanism is in the first operating condition, the second fulcrum means is in the first position thereof while the drive mechanism is in the second operating condition, and both of the first and second fulcrum means are in the second positions thereof while the drive mechanism is in the third operating condition.

5. A cam mechanism as claimed in claim 4 wherein the first fulcrum means is in the first position thereof while the drive mechanism is in the second operating condition.

6. A cam mechanism as claimed in claim 4 wherein the first and second finger followers are respectively pivotally mounted each at one end thereof on first and second slider members which in use are slidably mounted on or in a member fixed in position relative to an engine cylinder head.

7. A cam mechanism as claimed in claim 6 wherein both the first and second slider members are slidable on one post mounted on the cylinder head.

8. A cam mechanism as claimed in claim 6 wherein each of the first and second slider members is slidable in a cylinder defined in a tubular member connected to the cylinder head directly or via a rocker cover.

9. A cam mechanism as claimed in claim 7 wherein the first slider member is located on the post beneath the second slider member whereby when the second cam follower means is in engagement with the second cam means the second slider member abuts the top of the first slider member and causes the two slider members to move together.

10. A cam mechanism as claimed in claim 6, wherein each slider member is provided with lash adjustment means which connects the slider member to at least one of controlled cylinder head valves.

11. A cam mechanism as claimed in claim 10 wherein each slider member has a closed bore therein and the lash adjuster means comprises a hydraulic lash adjuster located in the closed bore, the hydraulic lash adjuster having a portion which abuts the top of a valve stem of one of the cylinder head valves.

12. A cam mechanism as claimed in claim 4 wherein the first and second movable fulcrum means each comprises an abutment member for abutting a finger follower and actuator means for moving the abutment member, the actuator means being operable to move each fulcrum means independently of the other fulcrum means.

13. A cam mechanism as claimed in claim 12 wherein each abutment member comprises a piston movable in a bore provided in a cylinder head of an engine or in a housing attached to the cylinder head, the piston defining a chamber within the bore and the piston being movable in response to changes in pressure in the chamber.

14. A cam mechanism as claimed in claim 4 wherein the first and second finger followers each have a curved lower exterior surface which abuts the fulcrum means.

15. A cam mechanism as claimed in claim 4 wherein the first and second finger followers are held in engagement with the fulcrum means by spring means.

* * * * *